United States Patent [19]

Mitchell

[11] Patent Number: 4,553,591

[45] Date of Patent: Nov. 19, 1985

[54] OIL WELL DRILLING APPARATUS

[76] Inventor: Richard T. Mitchell, P.O. Box 236, Broussard, La. 70518

[21] Appl. No.: 599,581

[22] Filed: Apr. 12, 1984

[51] Int. Cl.[4] ..... E21B 33/02

[52] U.S. Cl. ..... 166/76; 166/86; 166/95

[58] Field of Search ..... 166/75 R, 76, 78, 84, 166/86, 87, 88, 95, 97; 175/40, 48

[56] References Cited

U.S. PATENT DOCUMENTS

| | | | |
|---|---|---|---|
| 2,178,700 | 11/1939 | Penick et al. | 166/78 |
| 2,442,548 | 6/1948 | Mueller | 166/76 |
| 2,788,073 | 4/1957 | Brown | 166/78 |
| 2,830,666 | 4/1958 | Rhodes | 166/97 |
| 3,171,674 | 3/1965 | Bickel et al. | 166/87 |
| 3,409,084 | 11/1968 | Lawson, Jr. et al. | 166/86 |
| 4,202,410 | 5/1980 | Quebe | 166/97 |
| 4,289,199 | 9/1981 | McGee | 166/88 |

*Primary Examiner*—Stephen J. Novosad
*Assistant Examiner*—William P. Neader
*Attorney, Agent, or Firm*—Hiram P. Settle

[57] ABSTRACT

An apparatus for use with an oil well drilling apparatus, including an annular spool interposed permanently between the well blowout preventer stack and the upper bell nipple. The spool receives a plurality of different mandrels, including a test mandrel for testing the seals of the blowout preventers or adapting the drilling apparatus for wireline operations, and a shut-down mandrel for suspending a string of drill pipe within the well casing during a temporary shutdown. The different mandrels are each seated on an internal annular seat in the spool, are each peripherally sealing in the spool above the seat, and are retained by appropriate securing means urging the mandrel against the spool seat.

8 Claims, 6 Drawing Figures

OIL WELL DRILLING APPARATUS

BACKGROUND OF THE PRESENT INVENTION

The present invention is for utilization in connection with oil well drilling apparatus of the conventional type, including a lower well casing, and a blowout preventer stack superimposed on the casing and through which the drill pipe projects for drilling operations. The blowout preventer stack conventionally is surmounted by an upper bell nipple terminating closely beneath the rotary drilling table. The drill pipe string depends from the drilling table downwardly through the bell nipple, the upper annular blowout preventer, one or more ram-type blowout preventers, and into the casing.

The blowout preventers, of course, are intended to seal the annular space between the drill pipe and the string of casing to which the blowout preventer is attached in the event that the pressure within the well bore becomes excessive. Generally, the pressure of the drilling mud introduced into the drill string exceeds the formation pressure in the rocks exposed in the drilled hole. In the event of excess pressure, drilling mud failure, or the like, the blowout preventers are actuated to seal the annular space between the drill pipe and the casing.

It is necessary to test the blowout preventer stack from time to time to ensure proper operation of the preventers. However, repetitive testing by fully actuating the preventers, and particularly in the case of an annular blowout preventer, may well be destructive of the preventers themselves. Further, such testing has not completely tested all of the seals of the blowout preventers, particularly the cap seal of the annular blowout preventer and the top A.P.I. ring groove on the blowout preventer cap. It would be desirable to test each and every connection of the blowout preventer stack without actuating the blowout preventers.

Further, where it is desirable to run wireline tools, as for fishing or snubbing operations, in a complete, conventional drilling rig, it has been necessary either to remove the bell nipple or to close the annular preventer on the wireline lubricator. It would be desirable to adapt the conventional drill string to easy wireline operation without partially dismantling the rig or actuating the preventer.

Also, in temporarily shutting down a well during drilling operations, it has been conventional practice to remove the drill pipe from the casing, to store the drill pipe, and to cap off the casing. This involves considerable expense, the possible theft or damage of the drill pipe during storage at the drilling site, and a delay in restarting drilling operations. It would be desirable to have the capability of storing the drill pipe in the casing itself, where it is safe and quickly available for resumed drilling operations.

BRIEF DESCRIPTION OF THE PRESENT INVENTION

The present invention now provides a device for utilization in a conventional well drilling apparatus for performing the plural functions of testing the seals of a blowout preventer stack without actuation of the preventers, accommodating ready wireline operation, and accommodating well shutdown with the drill pipe stored in the well casing.

More specifically, this invention proposes the positioning of an annular spool or bowl between the drill rig blowout preventer stack and the bell nipple, the spool having an internal support seat and an axial passage opening onto the blowout preventer stack axial bore and communicating with the lower drill casing and the upper bell nipple.

Different types of inserts or mandrels are utilized with the annular spool, each such mandrel being seated upon the annular spool seat and being sealed within the spool above the seat. The spool or insert is permanently installed in the drilling rig at the specified location and is utilized in conjunction with one or the other of the specific mandrels hereinafter described to carry out a variety of well drilling functions.

One such mandrel is provided for testing each seal of the blowout preventer stack. This mandrel is installed in the spool and seated and sealed therein. The bore of the mandrel communicates with a depending pipe secured to the mandrel and extending downwardly through the blowout preventer stack to carry a sealing head at its lower end. This sealing head sealingly engages the interior of the well casing upon which the blowout preventers are mounted. Fluid under pressure is then introduced into one of the ram-type preventers of the blowout preventer stack with all of the stacks open. This fluid test pressure is introduced into the bore of the preventer without actuating the annular preventer and is confined between the mandrel on top of the stack and the seal head in the well casing. Any leakage of fluid from any one of the blowout preventer stack seals can be readily ascertained.

This same mandrel can be utilized for retaining the conventional string of drill pipe internally of the well casing in the event of a temporary well shutdown. The uppermost section of the drill pipe is secured to the bottom of the mandrel with the drill pipe string being suspended from the mandrel which is seated in the spool. A conventional shut-off valve, a pressure relief valve or a "Kelly" valve, is installed on top of the mandrel. Formation pressure within the well casing is retained by the mandrel seated in the spool and sealed therein. Any pressure interiorly of the drill pipe string is sealed by means of the valve surmounting the mandrel.

A different type of mandrel is provided with the same spool for converting the conventional well drilling apparatus to wireline tool operations, fishing operations or "snubbing" operations, or the like. In this mandrel, the mandrel is provided with an axial bore which is substantially smaller in diameter than the internal diameter of the blowout preventer stack, and a riser sub is attached to the upper end of the mandrel to project upwardly completely through the bell nipple and preferably through the rotary table to provide access for wireline operations. The conventional wireline lubricator and blowout prevention connectors are provided above the rotary table. The riser sub and the mandrel bore are of substantially the same diameter and serve to protect the interior of the blowout preventer stack from damage due to Kelly whip.

DETAILED DESCRIPTION OF THE PREFERRED EMBODIMENT

Figure 1:
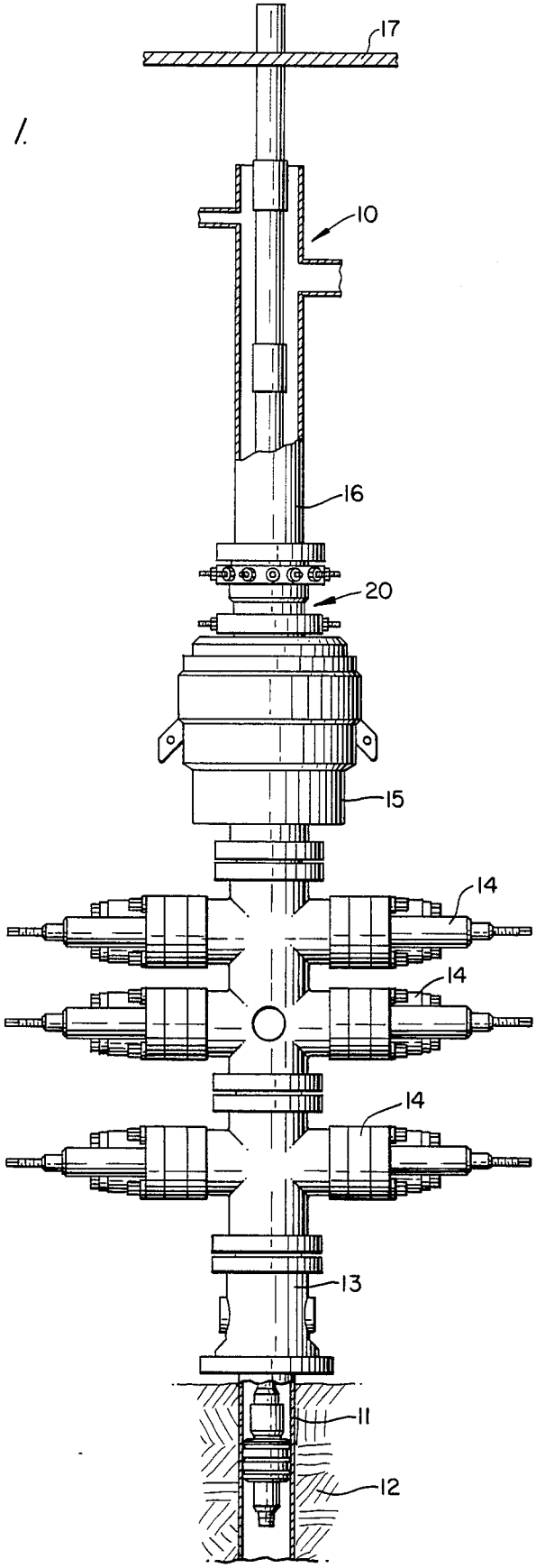
FIG. 1 is a vertical elevational view, with parts broken away and in section, of an oil drilling rig incorporating therein a spool of the present invention.

In FIG. 1, reference numeral 10 refers generally to an oil well drilling apparatus of the present invention, including a lower well casing 11 extending into a drilled wellhole in the ground 12. On top of the casing 11 is a first fitting 13 closing the casing and supporting an upper, vertical stack of ram-type blowout preventers 14.

Positioned on top of the ram-type blowout preventers 14 is an annular blowout preventer 15 surmounted by a spool 20 of the present invention. Superimposed on the spool 20 of the present invention is an upper bell nipple 16 which terminates beneath a rotary drill table 17. With the exception of the spool 20, the casing 11 and the assembly 13–17 thereabove are all conventional in the oil well drilling art.

Figure 2:
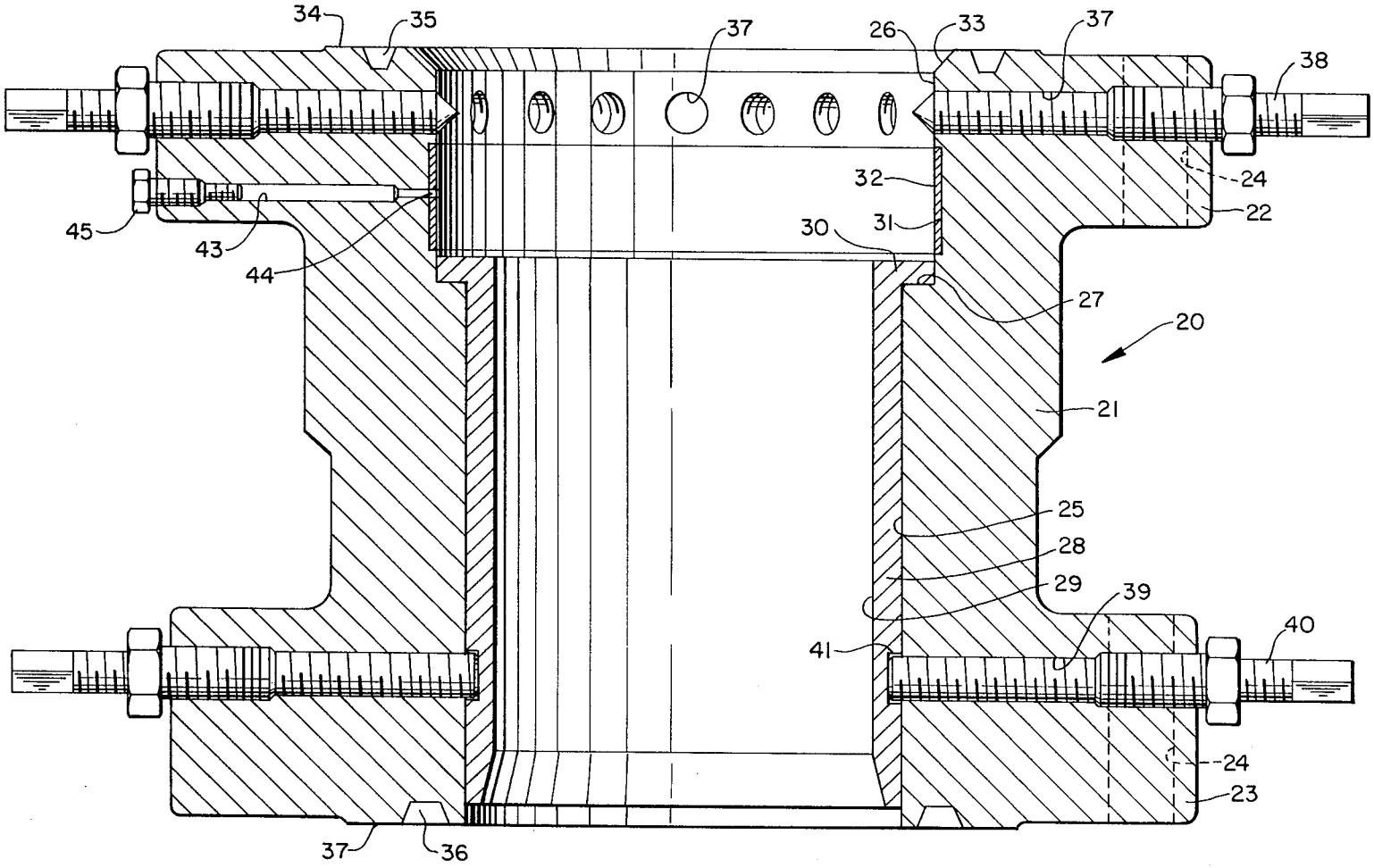
FIG. 2 is an enlarged view of the spool of the present invention.

In FIG. 2 of the drawings, the spool 20 of the present invention is illustrated in detail. It will be noted that this spool 20 is specifically interposed between the upper bell nipple 16 and the annular blowout preventer 15.

As best shown in FIG. 2 of the drawings, the spool 20 comprises a central, generally cylindrical body portion 21 having an upper, radially enlarged mounting flange 22 and a lower, radially enlarged mounting flange 23. The flanges 22 and 23 are provided with vertical apertures, indicated at 24, for the purpose of mounting the spool in the assembly by vertical bolts or screws passing through the apertures 24.

The body 21 of the spool 20 is provided with a central, axially extending, cylindrical passage 25 fully communicating with an upper enlarged counterbore 26 opening onto the upper surface of the spool 20. The bore 25 and the counterbore 26 define therebetween a radially enlarged, upwardly facing shoulder or seat 27. A cylindrical wear bushing or sleeve 28 is positioned snugly within the bore 25, the bushing 28 having a central vertical bore 29 and an upper, radially enlarged, outwardly projecting shoulder 30 integrally formed with the bushing and adapted to be seated on the shoulder 27. The counterbore 26 above the shoulder 27 is provided with a radially enlarged recess 31 within which a wear sleeve 32 is seated. The counterbore 26 is provided at its upper extremity with a radially outwardly flaring lead-in surface 33, and the upper face 34 of the spool 20 is provided with an annular seal groove 35. A similar annular seal groove 36 is provided in the bottom face 37 of the spool 20.

The upper flange 32 is provided with a plurality of radial threaded apertures 37 into which threaded lockscrews 38 are received for axial adjustment into and out of the counterbore 26. The lower flange 23 of the spool 20 is provided with a plurality of radially extending threaded bores 39 into which threaded lockscrews 40 are mounted. The exterior of the wear bushing 28 is provided with a locking groove 41 adapted to receive the inner ends of the lockscrews 34 therein to retain the wear bushing 28 in its illustrated position. A fluid pressure test port 43 is drilled into the upper flange 22, this test port being aligned with an aperture 44 in the sleeve 31 for a purpose to be hereinafter more fully described. A port closure plug 25 closes the port 43 when it is not in use, as illustrated in FIG. 2 of the drawings.

The spool 20 is adapted to receive alternative forms of mandrels for various purposes. One of these mandrels is illustrated in FIGS. 3 and 4 of the invention and is indicated by reference numeral 50.

The mandrel 50 is generally cylindrical in configuration and includes a main body portion 51 having a cylindrical periphery 52 which is sized to snugly fit within the counterbore 26 of the spool 20 in extended surface contact with the interior surface of the wear sleeve 32. The surface 52 has spaced peripheral grooves within which are mounted O-ring seals 53 which sealingly engage the sleeve 32. The lower portion of the mandrel 53 is downwardly and inwardly tapered as at 54 to a lower, reduced, exteriorly threaded boss 55 adapted to threadedly receive the internally threaded upper end of a section of drill pipe 56.

The upper end of the mandrel 51 is provided with an inclined exterior shoulder 57 which is adapted to engage the inner ends of the lockscrews 38 as the lockscrews are threaded inwardly in their threaded apertures 37. The mandrel bears at its upper end an upstanding embossment 58 which is internally threaded, as at 59, to receive a piece of drill pipe 60 or the like for facilitating insertion of the mandrel 50 into the spool 20.

Figure 3:
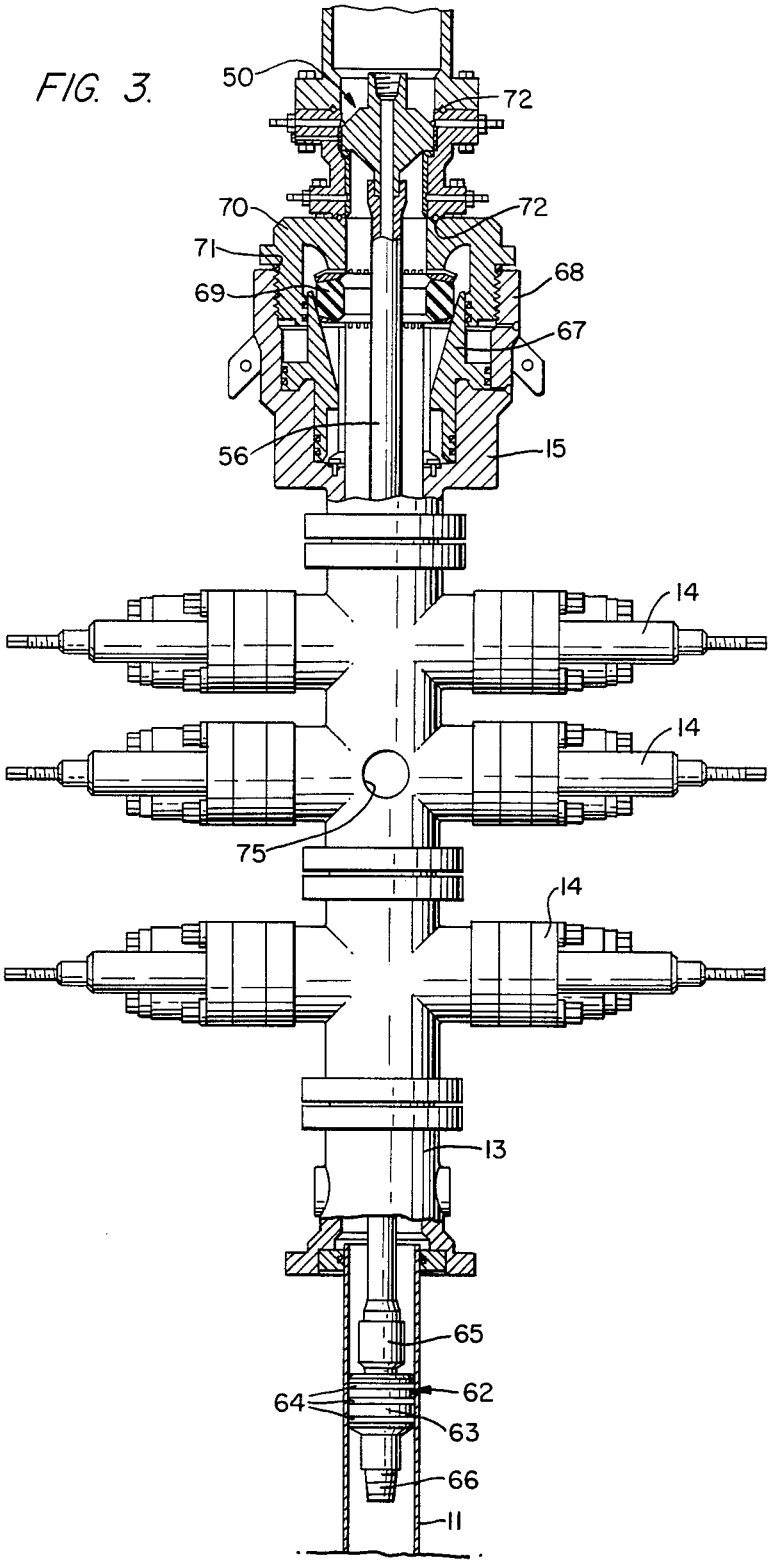
FIG. 3 is a view similar to FIG. 1, with parts broken away and in section, illustrating the device of the present invention as embodied in an apparatus for testing the seals of a blowout preventer stack.
Figure 4:
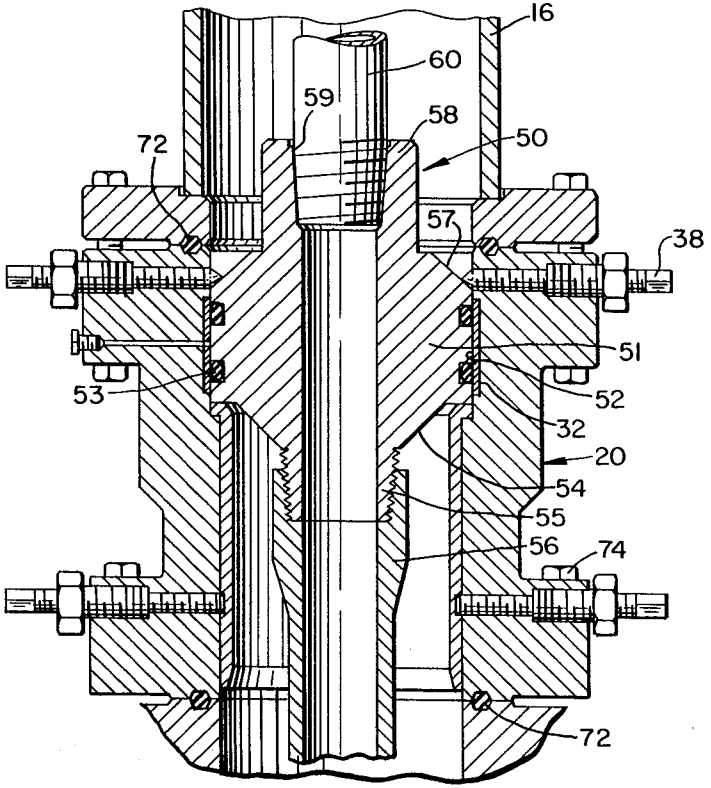
FIG. 4 is a view similar to FIG. 3 on an enlarged scale and with parts broken away.

The drill pipe 56 extends downwardly through the complete blowout preventer stack comprising the annular blowout preventer 15 and the plurality of ram-type blowout preventers 14, as will be seen from FIG. 3 of the drawings. Secured to the lower end of the drill pipe 56 is a cup-type tester indicated generally at 62 and comprising a cylindrical body portion 63 provided with a plurality of peripheral sealing rings or "O"-rings 64 which contact the interior wall of the well casing 11. The cylindrical body 62 carries at its upper end an inwardly threaded adapter 64 threaded to the lower end of the drill pipe 56 and a lower, exteriorly threaded extension 66.

From FIG. 3 of the drawings, it will be seen that, in use, the apparatus of the present invention serves to isolate a section of the well drilling apparatus which extends from immediately below the mandrel 50 which is peripherally sealed in the spool 20 downwardly through the lower portion of the spool 20, the annular blowout preventer 15, the stack of ram-type blowout preventers 14 and the lower support element 13 downwardly within the well casing to the cup-type tester 63 sealingly engaging the inner periphery of the well casing 11. As illustrated in FIG. 3 of the drawings, it will be seen that the annular blowout preventer 15 includes a vertically actuatable piston 67 disposed within the lower blowout preventer casing 68, the annular seal ring 69 collapsible inwardly upon actuation of the piston 67 and confined by the blowout preventer cap 70. The preventer cap 70 is sealed to the preventer casing by their threaded engagement and by an annular seal 71, and the blowout preventer cap is sealed to the spool 20 by the annular O-ring 72 interposed therebetween as the spool is retained on the blowout preventer by suitable means, as by the bolts 74.

The seal integrity of the complete blowout preventer stack, including the ram-type blowout preventers 14 and the annular blowout preventer 15 is tested by the injection of fluid under pressure into the blowout preventer stack, as through the port 75, while all of the blowout preventers 14, 15 are open. This fluid pressure, on the order of 3,000 to 20,000 pounds per square inch is injected into a sealed space between the tester 62 on the bottom and the mandrel 50 on the top. The piston 67 will not be actuated, and the seal 69 will not be collapsed onto the drill pipe 56, but the internal pressure and the annular blowout preventer will test the seals 71 and 72, as well as the seal at the joints between the various components of the blowout preventer stack.

After the testing has been completed, the injected hydraulic pressure is bled off, the retaining lockscrews are retracted, and the assembly of the mandrel 50, the drill pipe section 56 and the tester 62 is withdrawn vertically upwardly from its position of FIG. 3, and drilling operations are resumed.

Thus, it will be seen that the present invention provides for the testing of the sealing of the blowout preventer stack without actually cycling the blowout preventers and while confining the test hydraulic fluid to the confined space provided by a mandrel and cup assembly of FIG. 3.

Figure 6:
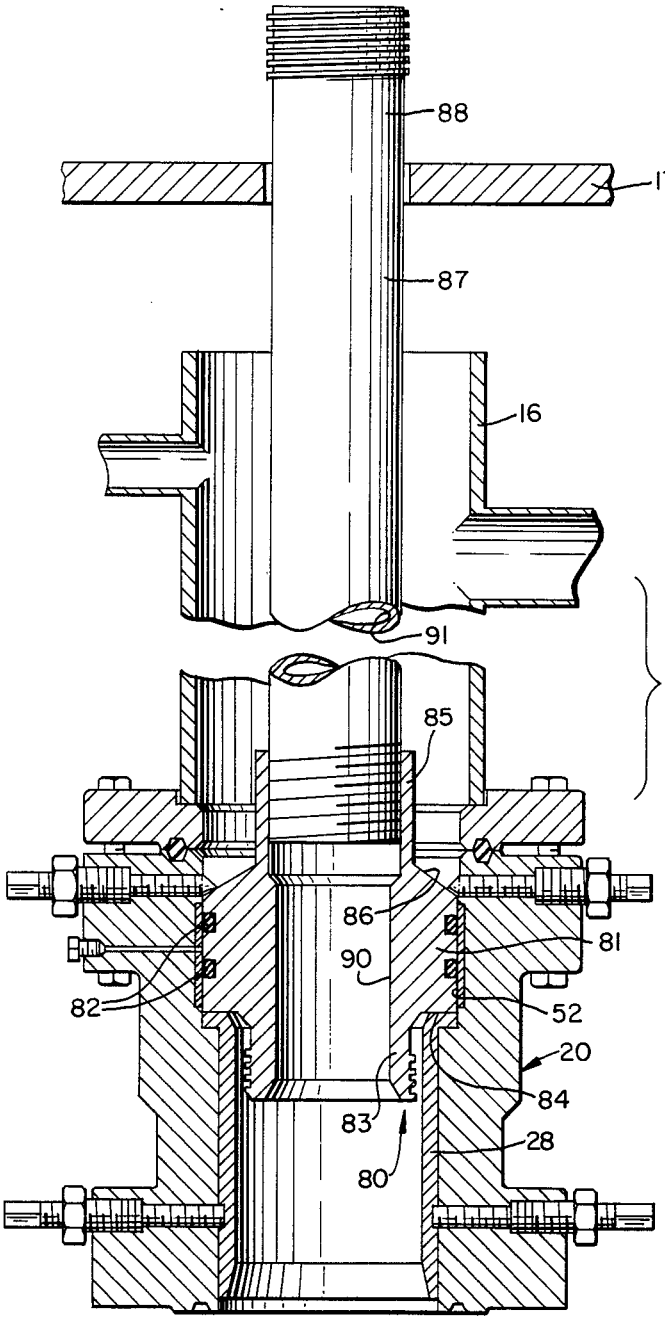
FIG. 6 is a view similar to FIG. 4, but showing a different form of mandrel for wireline tool operations.

In that version of the invention shown in FIG. 6 of the drawings, the mandrel 50 is identical with the mandrel previously described, the spool 20 is identical with the spool previously described, and all other portions of the apparatus are as previously described, with the exception that the mandrel 50 carries at its threaded bore end 55 a drill pipe 76 which constitutes the upper section of a complete string of drill pipe descending into the well casing 11. Also, the upper embossment 58 of the mandrel 50 has threaded thereinto the lower threaded end of an adapter 77 mounting a valve 78 disposed within the pipe nipple 16 above the mandrel 50. This valve 78 may be a conventional shutoff valve, a pressure relief valve or a "Kelly" valve, which, in effect, closes the open axial bore of the mandrel 50 and of the pipe string 76 depending therefrom.

Figure 5:
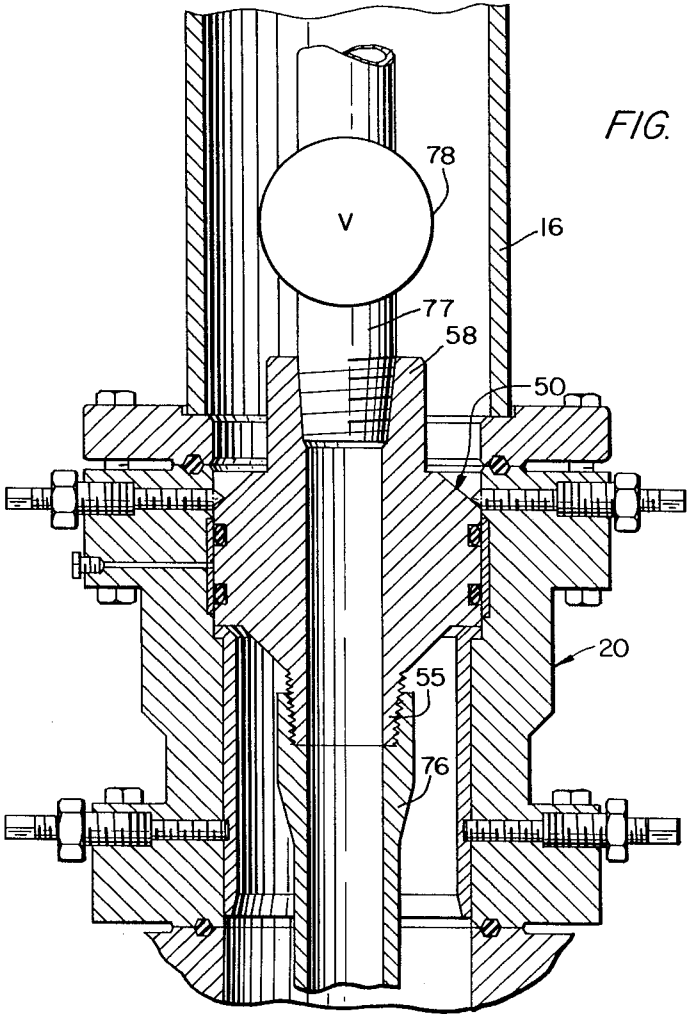
FIG. 5 is a view similar to FIG. 4, but illustrating the mandrel of FIG. 4 as adapted for well shut-in operation.

That embodiment illustrated in FIG. 5 of the drawings is utilized for the temporary shut-in of a well which is out of service. The complete drill string 76 is suspended and supported in the well by the mandrel 50 and a shutoff by the valve 78. Thus, the drill pipe can be safely stored in the well casing without danger of theft or damage during the period that the casing is shut in. In order to resume drilling operations, it is only necessary to pull the mandrel and the drill string upwardly, remove the mandrel, and install the next section of drill pipe.

In that version of the invention shown in FIG. 6, the spool 20 is identical with the spool hereinbefore described and is identically positioned in the drill rig.

However, a different type of mandrel is utilized, this mandrel being indicated by the reference numeral 80 and having a central, cylindrical body portion 81 of an external diameter to snugly fit within the bore 52 of the spool 20 and having a pair of O-rings 82 sealing the mandrel in the bore. The mandrel 80 has a reduced diameter lower portion 83 joined to the main body portion 81 by a radial shoulder 84 seated on the upper end of the wear bushing 28. The upper end of the mandrel is of reduced diameter, as at 85 and is joined to the mandrel body portion 81 by an inclined locking shoulder 86. The upper portion 85 is internally threaded to receive the lower threaded end of a wireline riser sub 87 which projects upwardly through the bell nipple 16 and upwardly through the rotary table 17, as at 88. The free upper end of the wireline riser sub 87 is threaded to accept a wireline lubricator and a Bowen blowout preventer, as is conventional in wireline operations.

The mandrel 81 is provided with a central vertical axial bore 90 which is of substantially reduced diameter, i.e., of substantially less diameter than the internal diameter of the wear bushing 28 and of the blowout preventer stack comprising the ram-type preventers 14 and the annular blowout preventer 15. The diameter of the bore 90 is substantially the same as the internal diameter 91 of the wireline riser sub 90. The reduced diameter bores 90 and 91 are adapted to receive a wireline and wireline tools of conventional design (not illustrated) for normal wireline fishing or snubbing operations, for example, yet the bores 90, 91, being of reduced diameter, confine any whipping of the wireline Kelly and prevent any damage to the spool 20 or the blowout preventer stack because of any such whipping.

Thus, it will be seen that the spool 20 and the mandrel 80 afford a convenient, readily usable adapter for wireline tool operations, while at the same time protecting the spool and the blowout preventer stack from damage due to such operations. The wireline operator is provided with a connection that is just about the rotary table 17 for convenient operation.

I claim:

1. A device for testing the seal integrity of a blowout preventer as it is installed in a drilling rig, the blowout preventer being superimposed on the well casing, comprising:

a. an annular spool superimposed on the blowout preventer stack, said spool having an internal axial bore provided with an upwardly facing annular support surface located medially of the bore, and an annular wear bushing seated on said support surface to depend therefrom;

b. a mandrel positioned in the spool bore to rest upon said wear bushing, means for securing said mandrel in said bore and urging it against said support surface, "O" ring sealing means interposed between said mandrel and said bore;

c. a section of drill pipe carried by said mandrel and depending therefrom to project axially through the blowout preventer and to terminate beneath the blowout preventer within the well casing;

d. an "O" ring seal means at the lower end of said drill pipe engaging interior of said casing; and e. means for injecting fluid under pressure between the mandrel and the "O" ring seal of (d) above.

2. A device for a drilling rig wireline operation, the rig including an annular blowout preventer, comprising:

a. an annular spool secured on top of the blowout preventer;

b. a mandrel secured in and sealed to the spool bore, said mandrel having an internal bore of less diameter than the internal diameter of said blowout preventer;

c. a bell nipple superimposed on said annular spool; and d. a wireline riser sub secured to said mandrel and extending upwardly therefrom to project through the upper bell nipple, said riser sub being of substantially the same internal diameter as the internal bore of said mandrel, the reduced diameter bore of said mandrel protecting the annular blowout preventer against whipping of a wireline assembly extending through said riser sub and said mandrel.

3. A device for shutting in a drilling rig with the drill pipe in place, said rig including a blowout preventer stack superimposed on the well casing, comprising:

a. an annular spool sealed to the upper extremity of the blowout preventer stack, said spool having an internal axial bore provided with an upwardly facing annular support surface located medially of the bore;

b. a mandrel inserted in the spool bore to rest upon said support surface, means sealing said mandrel in said bore;

c. means at the lower extremity of said mandrel for attachment to the drill pipe, so that the drill pipe is suspended from said mandrel; and d. valve means normally closing the mandrel bore.

4. A device for testing the seal integrity of a blowout preventer stack as it is installed in a drilling rig, the blowout preventer stack being interposed between a lower well casing and an upper bell nipple, comprising:

a. an annular spool interposed between the blowout preventer stack and the bell nipple in seating engagement therewith, said spool having an internal axial bore provided with an upwardly facing annular support surface located medially of the bore;

b. a mandrel telescopically snugly fitting in the spool bore to rest upon said support surface, means securing said mandrel in said bore and urging it against said support surface, peripheral sealing means interposed between said mandrel and said bore;

c. an axially elongated support means secured at its upper end to said mandrel and depending therefrom axially through the complete blowout preventer stack to terminate beneath the blowout preventer stack and within the lower well casing;

d. seal means at the lower end of said support sealingly engaging the interior of said casing;

e. said mandrel and said lower sealing means carried thereby defining therebetween an isolated, fluid-tight section of said drilling rig including the entire blowout preventer stack; and f. means for injecting a fluid under pressure into said isolated section to test the seal integrity of the complete blowout preventer stack.

5. A device for wireline operation in a drilling rig having a blowout preventer stack interposed between an upper bell nipple and a lower well casing, comprising:

a. an annular spool interposed between the blowout preventer stack and the bell nipple in sealing engagement therewith, said spool having an internal axial bore provided with an upwardly facing annular support surface located medially of the bore;

b. a mandrel telescopically fitting in the spool bore to rest upon said support surface, means securing said mandrel in said bore and urging it against said support surface, peripheral sealing means interposed between said mandrel and said bore, said mandrel having an internal bore of less diameter than the internal diameter of said blowout preventer stack; and c. a wireline riser sub secured to the upper extremity of said mandrel and extending upwardly therefrom to project through the upper bell nipple, said riser sub being of substantially the same internal diameter as the internal bore of said mandrel, and the reduced diameter bore of said mandrel protecting the blowout preventer stack against whipping of a wireline assembly extending therethrough.

6. A device for shutting in a drilling rig with the drill pipe in place, said rig including a blowout preventer stack interposed between the well casing and an upper bell nipple, comprising:

a. an annular spool interposed between the blowout preventer stack and the bell nipple in sealing engagement therewith, said spool having an internal axial bore provided with an upwardly facing annular support surface located medially of the bore;

b. a mandrel telescopically snugly fitting in the spool bore to rest upon said support surface, means securing said mandrel in said bore and urging it against said support surface, peripheral sealing means interposed between said mandrel and said bore;

c. means at the lower extremity of said mandrel for attachment to the drill pipe, the drill pipe being suspended from said mandrel and supported by the engagement of said mandrel with said spool support surface; and d. a valve superimposed on said mandrel and normally closing the mandrel bore.

7. A device for diverse use in an oil drilling rig having a blowout preventer stack interposed between the well casing and an upper bell nipple, comprising:

a. an annular spool interposed between the blowout preventer stack and the bell nipple in sealing engagement therewith, said spool having an internal axial bore provided with an axially medially located, vertically upwardly facing support ledge;

b. a first annular mandrel insertable into said spool to seat on said support surface and in peripherally sealed engagement with the internal bore of the spool above said surface, and means for suspending a drill pipe from said first mandrel to project axially downwardly into said well casing;

c. a second annular mandrel insertable into said spool as an alternative to said first mandrel, said second mandrel being seated on said support surface in peripherally sealed relation with the internal bore of the spool above said surface, and means for superimposing a wireline riser sub on said second mandrel to project upwardly axially through said upper bell middle.

8. A device for diverse use in an oil drilling rig having a blowout preventer stack interposed between the well casing and an upper bell nipple, comprising:

a. an annular spool interposed between the blowout preventer stack and the bell nipple in sealing engagement therewith, said spool having an axial bore provided with an internal, axially medially located, vertically upwardly facing support ledge; and b. an annular mandrel inserted into said spool bore to seat on said ledge, said mandrel having peripheral "O" ring seals engaging the inner periphery of said bore above ledge, said mandrel in a first embodiment having a lower threaded extremity for receiving a length of drill pipe projecting downwardly through a blowout preventer stack, and in a second embodiment having an upwardly projecting threaded extremity for threaded engagement with a wireline riser sub projecting upwardly through the bell nipple.

* * * * *